US008543041B2

(12) United States Patent
Nose et al.

(10) Patent No.: US 8,543,041 B2
(45) Date of Patent: Sep. 24, 2013

(54) IMAGE FORMING APPARATUS

(75) Inventors: Katsuya Nose, Matsudo (JP); Akihiro Noguchi, Toride (JP); Kyosuke Takahashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 13/273,104

(22) Filed: Oct. 13, 2011

(65) Prior Publication Data

US 2012/0148313 A1 Jun. 14, 2012

(30) Foreign Application Priority Data

Dec. 8, 2010 (JP) ..... 2010-273912

(51) Int. Cl.
*G03G 15/09* (2006.01)

(52) U.S. Cl.
USPC ..... 399/267; 299/269

(58) Field of Classification Search
USPC ..... 399/267, 269
See application file for complete search history.

(56) References Cited

U.S. PATENT DOCUMENTS

| | | | | |
|---|---|---|---|---|
| 7,092,656 | B2 * | 8/2006 | Yokokawa | 399/104 |
| 7,561,838 | B2 * | 7/2009 | Sakamaki et al. | 399/269 |
| 7,725,061 | B2 * | 5/2010 | Sakamaki et al. | 399/269 |

FOREIGN PATENT DOCUMENTS

| | | | |
|---|---|---|---|
| JP | 2004-21125 | A | 1/2004 |
| JP | 2010-096922 | A | 4/2010 |
| JP | 2013015702 | A * | 1/2013 |

* cited by examiner

*Primary Examiner* — G. M. Hyder
(74) *Attorney, Agent, or Firm* — Canon U.S.A., Inc., IP Division

(57) ABSTRACT

The specification discloses a developing device comprises a first developer bearing member configured to bear a developer including a toner and a carrier, and to convey the developer to a first developing region facing an image bearing member, so as to develop an electrostatic latent image formed onto the image bearing member and a second developer bearing member configured to bear a developer transferred from the first developer bearing member, and to develop an electrostatic latent image formed on the image bearing member, by conveying a developer to a second developing region facing the image bearing member and a cover unit configured to shield a route toward the image bearing member from a mutual gap position between the first developer bearing member and the second developer bearing member.

4 Claims, 14 Drawing Sheets

FIGURE AS VIEWED FROM CROSS-SECTION PERPENDICULAR TO ROTATING DIRECTION

FIGURE AS VIEWED FROM PHOTOSENSITIVE DRUM

FIGURE AS VIEWED FROM CROSS-SECTION PERPENDICULAR TO ROTATING DIRECTION

FIGURE AS VIEWED FROM PHOTOSENSITIVE DRUM

FIGURE AS VIEWED FROM CROSS-SECTION PERPENDICULAR TO ROTATING DIRECTION

FIGURE AS VIEWED FROM PHOTOSENSITIVE DRUM

FIGURE AS VIEWED FROM CROSS-SECTION PERPENDICULAR TO ROTATING DIRECTION

FIGURE AS VIEWED FROM PHOTOSENSITIVE DRUM

FIGURE AS VIEWED FROM CROSS-SECTION PERPENDICULAR TO ROTATING DIRECTION

FIGURE AS VIEWED FROM PHOTOSENSITIVE DRUM

IMAGE FORMING APPARATUS

BACKGROUND OF THE INVENTION

1. Field of the Invention

The present invention relates to a developing device for developing an electrostatic latent image formed on an image bearing member of an electrophotographic copying machine or a laser beam printer, into a toner image.

2. Description of the Related Art

In image forming apparatuses such as electrophotographic copying machines, developing devices conventionally applied to these image forming apparatuses, adopting a powder cloud method, a cascade method, a magnetic brush method are known. Among them, in a case of the magnetic brush method of a two-component development system, a two-component developer including and mixed with a magnetic carrier, a toner and the like is attracted to a magnetic field generating unit. Then, the developer is caused to ear up in a brush shape in magnetic pole portions, and an electrostatic latent image is developed by subjecting an electrostatic latent image on the photosensitive drum to friction, thereby image formation is carried out. In this case, since the magnetic carrier itself in the developer functions as a soft developing electrode, it is possible to cause the toner to adhere thereto in proportion to a charge density of the electrostatic latent image, in other words, it is suitable for reproduction of gradation image. In addition, the developing device itself has a feature that it can be configured in a small size.

As a magnetic brush developing device of the two-component development system, a magnetic brush development method employing a developing sleeve serving as a developer bearing member is generalized. To accomplish the purpose of efficiently developing the electrostatic latent image on the photosensitive drum, first, a two-component developer including a magnetic carrier made of powder of magnetic material such as, for example, ferrite, and a toner with pigment being dispersed into a resin, is agitated and mixed. Then, the toner is caused to possess an electric charge by frictional charging generated by friction with each other. On the other hand, the developing sleeve serving as a hollow cylindrical developer bearing member made of a nonmagnetic material having magnetic poles in the interior thereof is caused to retain the developer. The developer is conveyed from a developer container to a developing region facing the photosensitive drum, by the developing sleeve. In the developing region, by causing the developer to ear up by an action of the above-described magnetic field, and subjecting the developer to friction on the photosensitive drum surface, thereby the electrostatic latent image formed on the photosensitive drum is developed. The two-component magnetic brush development method employing the developing sleeve is used in many products, mainly in a monochrome digital copying machine or a full-color copying machine requiring a high image quality.

However, if a rotational movement speed of the photosensitive drum is made faster to respond to demand for speeding up to recent copying machines, development time is not sufficient with one developing sleeve, and as a result, preferred image formation may not be performed.

As a countermeasure against this case, there is a method for enhancing development efficiency by increasing a circumferential speed of the developing sleeve. However, when the circumferential speed of the developing sleeve is increased, a centrifugal force acting on the developer which forms the magnetic brush is increased, and scattering of the developer increases in amount. As a result, there is a negative effect, which could lead to causing contamination in the interior of the copying machine, and deteriorating the functions of the apparatus.

Therefore, as another countermeasure, as discussed in Japanese Patent Application Laid-Open No. 2004-21125, two, or three or more developer bearing members such as a developing sleeves are used and arranged to bring their circumferential surfaces into close proximity so that they adjoin each other. Then, a method for extending development time and enhancing development ability, by allowing the developer to be continuously conveyed traveling on each other's circumferential surface, what is called a multi-stage magnetic brush developing method is discussed.

Here, in the developing device provided with plural developing sleeves as described above, the developer may leak out from a spacing between an upstream developing sleeve and a downstream developing sleeve, in longitudinal end portions of the developing sleeves (non-developer-bearing region). A problem that the developer or toner aggregates leaks out of the spacing of such developing sleeves cannot be solved only by a technique for the past general end portion configuration (e.g., a technique for arranging magnetic members or magnet members in the developing sleeve end portions).

Thus, for example, Japanese Patent Application Laid-Open No. 2010-096922 discusses a configuration of providing a cover member, in the outside of developer bearing regions of an upstream developing sleeve and a downstream developing sleeve, on a path routed from a spacing between the upstream developing sleeve and the downstream developing sleeve toward the opposed image bearing member. It is configured such that the developer leaking from the spacing between the upstream developing sleeve and the downstream developing sleeve is shielded from scattering to the image bearing member by the cover member, and is guided and recovered into the developer container.

Under such circumstances, the inventors studied a developing device of multi-stage magnetic brush development type provided with plural developing sleeves, in accordance with the configuration of the conventional technique discussed in the Japanese Patent Application Laid-Open No. 2010-096922. In other words, in a case where a cover member is provided in the outside of the developer bearing region, a sheet supply endurance test for a long period of time was conducted. In this case, a problem as below may occur.

Specifically, a toner drop may occur at an end portion of supplied sheet, during the sheet supply endurance test for a long period of time. Toner drop herein used is a phenomenon in which a toner drops or flies onto originally unintentional area on the sheet, and can end up contaminating an image. Furthermore, when positions at which the toner drops occurred on images were investigated, it was found that the toner drops occurred at an inner side than the cover member in the longitudinal direction, in other words, in the developer bearing region.

Thus, further observations were carried out to identify occurrence locations of the toner drops. Then, it was found that there are toner aggregates flying from longitudinal end portions (outside the developer bearing region, a spacing G2 described in Japanese Patent Application Laid-Open No. 2010-096922) of the spacing between the upstream developing sleeve and the downstream developing sleeve, toward the center of the longitudinal direction. It became clear that such toner aggregates flying toward the center of longitudinal direction, cannot be sufficiently shielded by a cover member discussed in Japanese Patent Application Laid-Open No. 2010-096922, and toner drop images may end up occurring.

SUMMARY OF THE INVENTION

The present invention is directed to suppressing toner aggregates flying out of between the sleeves in longitudinal end portions in the outside of developer bearing regions, toward the center in the longitudinal direction, in a developing device provided with a plurality of developing sleeves.

Furthermore, the present invention is directed to providing a developing device prepared for suppressing an occurrence of toner drop.

According to an aspect of the present invention, a developing device includes a first developer bearing member configured to bear a developer including a toner and a carrier, and to convey the developer to a first developing region facing an image bearing member, so as to develop an electrostatic latent image formed onto the image bearing member, a second developer bearing member configured to bear a developer transferred from the first developer bearing member, and to develop an electrostatic latent image formed on the image bearing member, by conveying a developer to a second developing region facing the image bearing member, and a cover unit configured to not overlap respective developing regions at end portions in axis line direction of the first and the second developer bearing members, and to shield a route toward the image bearing member from a mutual gap position between the first developer bearing member and the second developer bearing member to the image bearing member. The cover unit has a projection portion that projects with respect to an axis line direction of the first developer bearing member, so as to shield more inward regions than end portions of respective developing regions between the respective developing regions.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinbelow, a developing device that constitutes a first exemplary embodiment according to the present invention will be described in detail.

Figure 1:
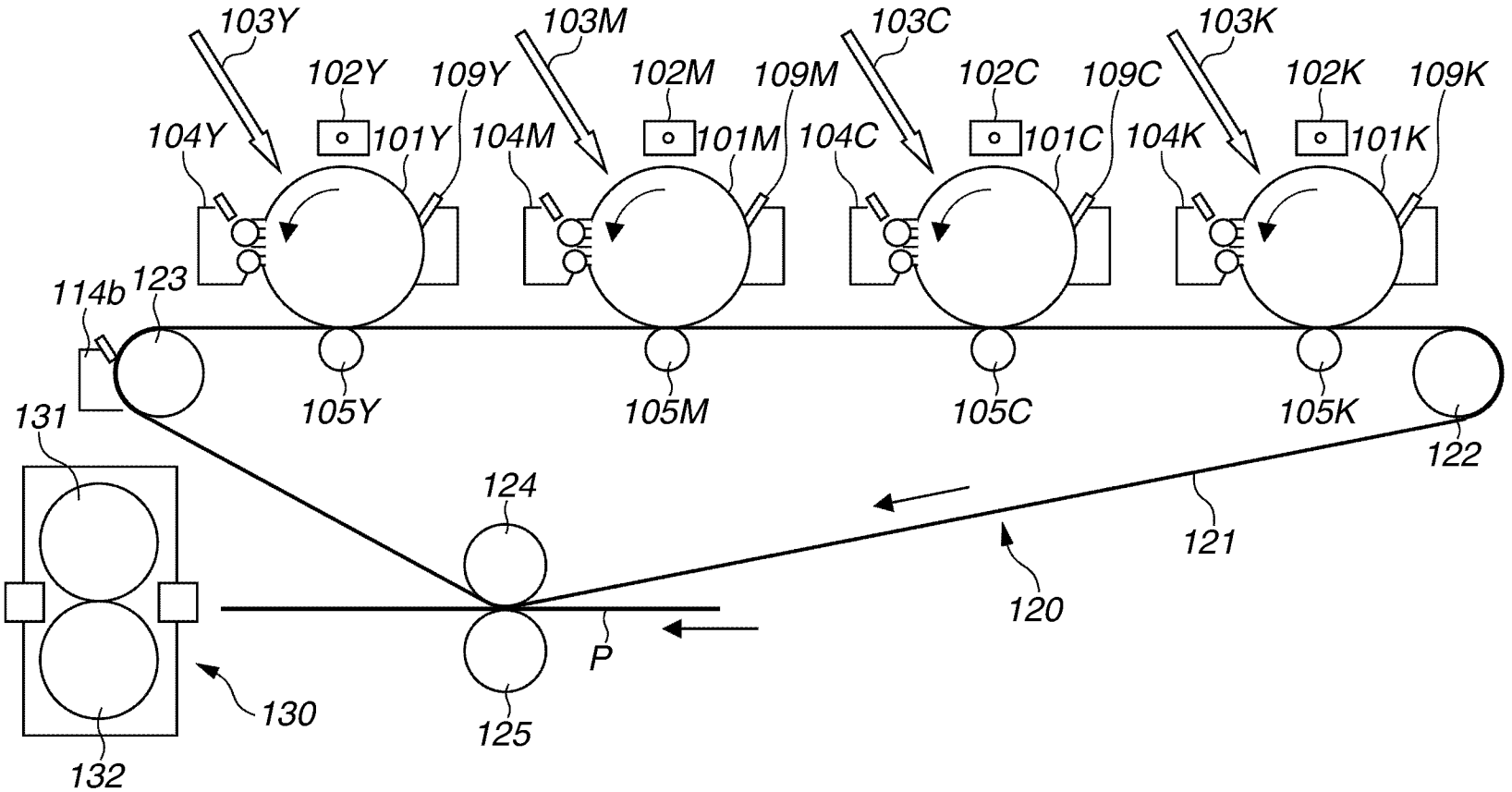
FIG. 1 illustrates a schematic view of an image forming apparatus to which the present invention can be applied.

An outline of an image forming apparatus to which the developing device according to the present invention can be applied will be described. As illustrated in FIG. 1, the image forming apparatus, to which the developing device according to the present invention can be applied, includes four image formation stations Y, M, C, and K each provided with photosensitive drum 101 (101Y, 101M, 101C, 101K) serving as a latent image bearing member. Below each image formation station is arranged an intermediate transfer device 120. The intermediate transfer device 120 is configured such that an intermediate transfer belt 121 serving as an intermediate transfer member is stretchedly provided by rollers 122, 123, an 124, and travels in a direction indicated by an arrow.

In the present exemplary embodiment, the surface of the photosensitive drum 101 is charged by a primary charging device 102 (102Y, 102M, 102C, 102K) of a corona charging type serving as a non-contact type charging device. Then, the surface of the charged photosensitive drum 101 is exposed to a laser 103 (103Y, 103M, 103C, 103K) each driven by a laser driver (not illustrated). In doing so, an electrostatic latent image is formed on the photosensitive drum 101. Each toner image of yellow, magenta, cyan, and black is formed by developing the latent image by a developing unit 104 (104Y, 104M, 104C, 104K).

The toner image formed on each image formation station is transferred and superimposed onto an intermediate transfer belt 121 made of polyimide-based resin, by applying a transfer bias by a transfer roller 105 (105Y, 105M, 105C, 105K) serving as a primary transfer unit. The toner image of four colors formed on the intermediate transfer belt 121 is transferred onto a recording paper P by a secondary transfer roller 125 serving as a secondary transfer unit arranged facing the roller 124. The toner which has remained on the intermediate transfer belt 121 without being transferred onto the recording paper P, is removed by an intermediate transfer belt cleaner 114*b*. The recording paper P on which the toner image has been transferred is pressurized/heated by a fixing device 130 equipped with fixing rollers 131 and 132 to obtain a permanent image. Further, a primary transfer residual toner, which has remained on the photosensitive drum 101 after the primary transfer, is removed by a cleaner 109 (109Y, 109M, 109C, 109K) to prepare for the next image formation.

A configuration around the photosensitive drum of the image forming apparatus will be described below. Furthermore, in FIG. 2, a configuration around the photosensitive drum serving as the latent image bearing member, of the image forming apparatus to which the developing device according to the present invention can be applied, will be described in detail. Here, since a configuration around the photosensitive drum for each color is similar to each other, a configuration for a certain color will be described on behalf of all.

Figure 2:
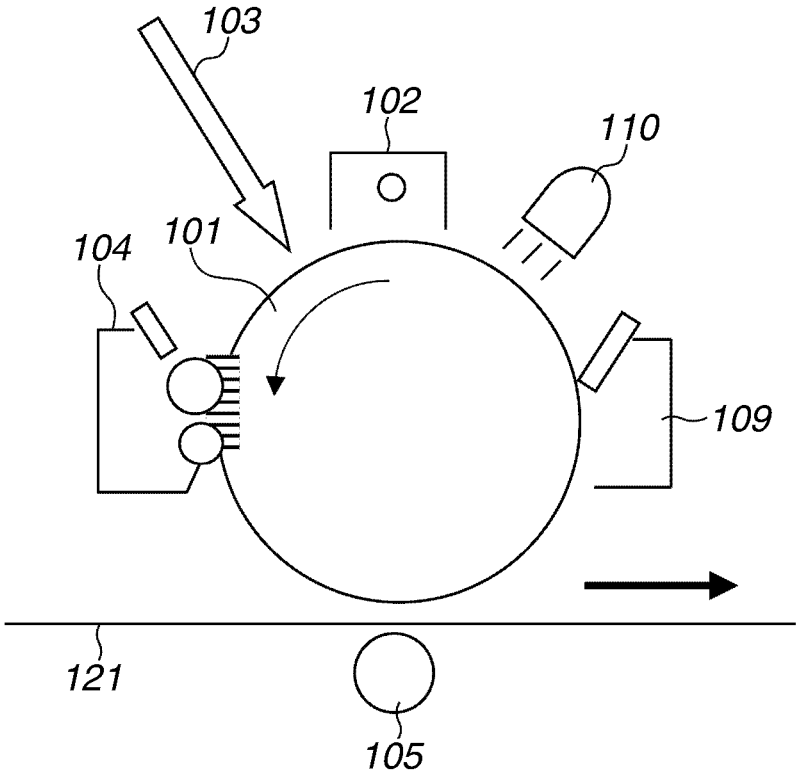
FIG. 2 illustrates a schematic view around an image bearing member of the image forming apparatus to which the present invention can be applied.

In FIG. 2, in the image forming apparatus according to the present exemplary embodiment, the photosensitive drum 101 serving as an electrostatic latent image bearing member is rotatably provided. Then, an electrostatic latent image is formed on the photosensitive drum 101 by exposing the surface of the photosensitive drum 101 uniformly charged by a primary charger 102 of non-contact charging type (corona type) to a laser light emitting element 103. The electrostatic latent image is visualized by a developing device 104. Next, the visualized image is transferred onto an intermediate transfer belt 121 by a transfer roller 105. Further, transfer residual toner on the photosensitive drum 101 is removed by a cleaning device 109 of a cleaning blade contact type. Furthermore, an electric potential on the photosensitive drum 101 is erased by a pre-exposure lamp 110, and the photosensitive drum 101 serves again for image formation.

A configuration of the developing device will be described. Furthermore, the developing device 104 will be described referring to FIG. 3 and FIG. 4. In the present exemplary embodiment, the developing device 104 is equipped with a developer container 2, and a two-component developer 1 including a toner and a carrier as a developer is contained within the developer container 2. In addition, the developing device 104 is equipped with two developing sleeves serving as a developer bearing unit within the developer container 2. Specifically, the developing device 104 is each equipped with a developing sleeve 6 serving as a first developer bearing member, and a developing sleeve 7 serving as a second developer bearing member.

The two-component developer 1 is conveyed from the developing sleeve 6 on an upstream side in relation to a developer conveyance direction "b" to the developing sleeve 7 on a downstream side. Furthermore, the developing device 104 has an ear-cutting member 5 for regulating a length of ears of the developer borne on the developing sleeve 6.

Figure 3:
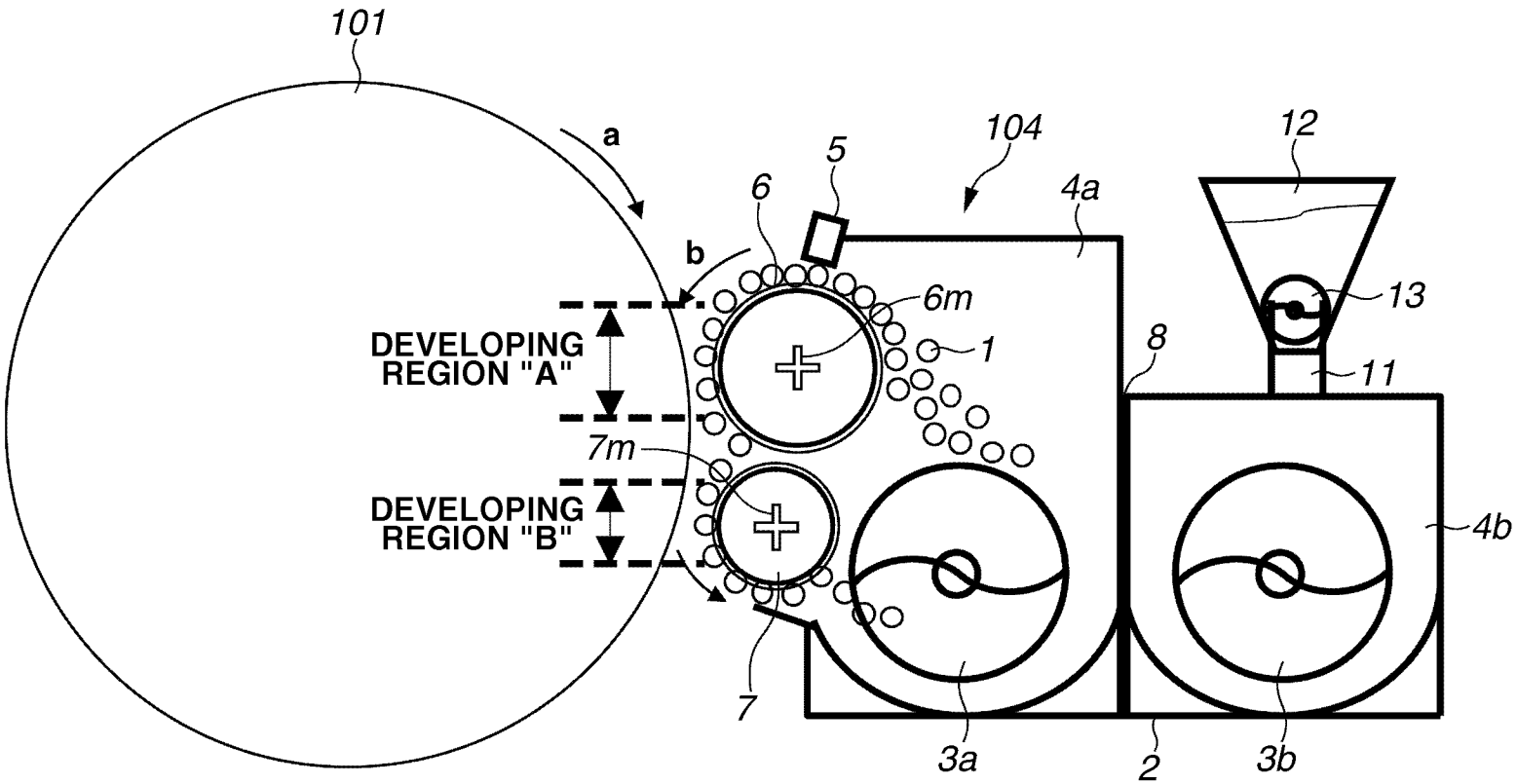
FIG. 3 illustrates an outline (cross-sectional view) of a developing device according to a first exemplary embodiment of the present invention.
Figure 4:
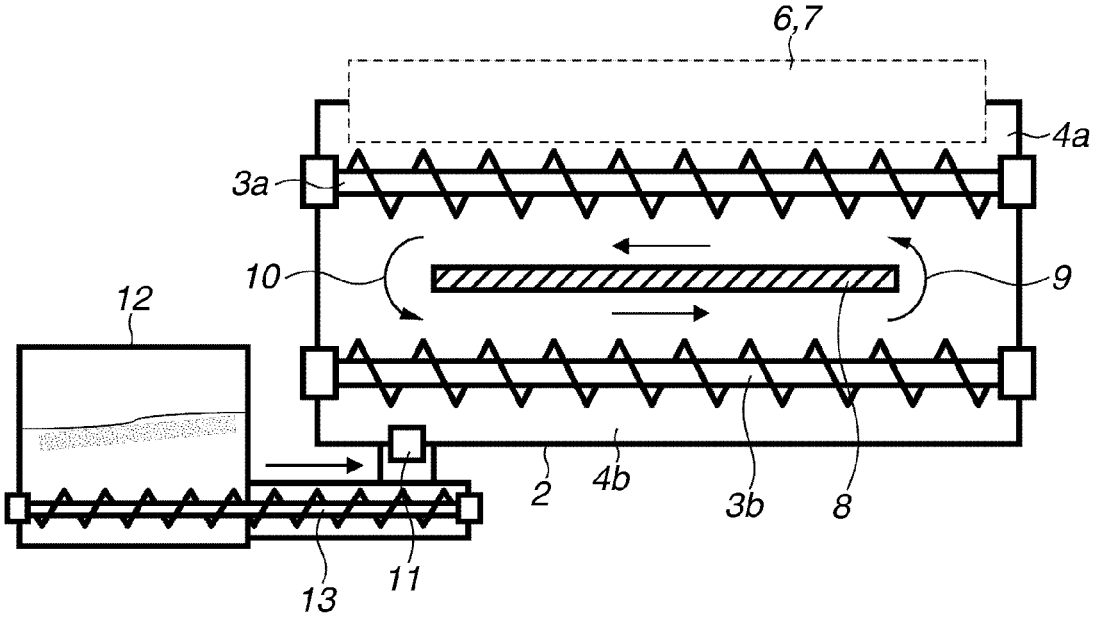
FIG. 4 illustrates an outline (longitudinal view) of the developing device according to the first exemplary embodiment of the present invention.

In the present exemplary embodiment, the interior of the developer container 2 is vertically partitioned into a developing chamber 4*a* and an agitating chamber 4*b* on left and right sides in a horizontal direction at the substantially intermediate position of the developer container 2 by a partition wall 8 extending in a direction perpendicular to the plane of FIG. 3. The developer is accommodated in the developing chamber 4*a* and the agitating chamber 4*b*.

In the developing chamber 4*a* and the agitating chamber 4*b*, a first conveying screw 3*a* and a second conveying screw 3*b* each serving as a conveying member as a developer agitating/conveying unit are arranged, respectively. The first conveying screw 3*a* is disposed in the bottom portion of the developing chamber 4*a* to be substantially parallel along an axial direction of the developing sleeves 6 and 7, and conveys the developer in the developing chamber 4*a* in one direction along the axis line thereof by rotation. Further, the second conveying screw 3*b* is disposed in the bottom portion of the agitating chamber 4*b* to be substantially parallel to the first conveying screw 3*a*, and conveys the developer in the agitating chamber 4*b* in a direction opposite to the conveying direction of the first conveying screw 3*a*.

In this manner, conveyance by the rotations of the first conveying screw 3*a* and the second conveying screw 3*b* causes the developer to circulate between the developing chamber 4*a* and the agitating chamber 4*b* via opening portions (i.e., communicating portions) 9, 10 (see FIG. 4) provided at both ends of the partition wall 8.

In the present exemplary embodiment, the developing chamber 4*a* and the agitating chamber 4*b* are disposed left and right in the horizontal direction. However, even in the developing device in which the developing chamber 4*a* and the agitating chamber 4*b* are disposed one above another, or in the developing device in another form, the present invention can be applied.

In the present exemplary embodiment, there is an opening portion at a position corresponding to a developing region "A" and a developing region "B" each facing the photosensitive drum 101 of the developer container 2. In the opening portion, the developing sleeves 6 and 7 are rotatably disposed to be partly exposed in the photosensitive drum direction.

In the present exemplary embodiment, a diameter of the upstream developing sleeve 6 is 24 mm, a diameter of the downstream developing sleeve 7 is 20 mm, a diameter of the photosensitive drum 101 is 80 mm, and a closest proximity region between the developing sleeves 6 and 7 and the photosensitive drum 101 has a distance of about 400 μm. Through this configuration, setting is made so that developing operation can be carried out, in a state where the developer conveyed to the developing region "A" and the developing region "B" is brought into contact with the photosensitive drum 101. The developing sleeves 6 and 7 are composed of non-magnetic material such as aluminum or stainless steel, and in the interiors thereof are installed in a unrotatable state magnet rollers 6*m* and 7*m* each serving as a magnetic field generation unit.

In the above-described configuration, the developing sleeves 6 and 7 rotate in a direction indicated by the arrow "b" (counterclockwise direction) as illustrated in FIG. 3 during the developing operation, and bear the two-component developer of which layer thickness has been regulated by ear-cutting of the magnetic brush by the ear-cutting member 5. The developing sleeves 6 and 7 convey the developer of which layer thickness is regulated, to the developing region "A" facing the photosensitive drum 101, and supply the developer to the electrostatic latent image formed on the photosensitive drum 101 to develop the latent image. In this case, to improve the developing efficiency, i.e., the rate of toner applied to the latent images, a developing bias voltage composed of direct current (DC) voltage superimposed with alternating current (AC) voltage is applied from an electric power source (not illustrated) to the developing sleeves 6 and 7. In the present exemplary embodiment, the developing bias voltage composed of the DC voltage of −500 V and the AC voltage with peak-to-peak voltage Vpp of 1800V, at frequency "f" of 12 kHz is used. However, a DC voltage value, or an AC voltage waveform is not limited to this.

Generally, in the two-component magnetic brush development method, when an AC voltage is applied, developing efficiency increases and an image becomes high grade, but in contrast, fogging is liable to occur. For this reason, prevention of fogging is performed by providing a potential difference between a DC voltage to be applied to the developing sleeves 6 and 7 and a charge potential (i.e., white background potential) of the photosensitive drum 101.

A regulating blade 5 serving as the ear-cutting member is composed of a plate-like member which extends along longitudinal axis lines of the developing sleeves 6 and 7. As a material of the regulating blade 5, a non-magnetic material such as aluminum or stainless steel, or a magnetic low-carbon steel material such as cold-rolled steel (SPCC), or a bonded member with the non-magnetic material and the magnetic material is used. Further, the regulating blade 5 is disposed being opposed to the developing sleeve at a position upstream side of a developing position being opposed to the photosensitive drum 101 in the direction of the developing sleeve rotation. Then, the developer (both toner and carrier) passes between an end portion of the ear-cutting member 5 and the developing sleeve 6, and is supplied to the developing region "A".

An ear-cutting amount of the magnetic brushes of the developer borne on the developing sleeves 6 and 7 is regulated, by adjusting the size of the gap between the regulating blade 5 and the surface of the developing sleeve 6. Thus, the amount of the developer to be conveyed to the developing region can be adjusted. The gap between the regulating blade 5 and the developing sleeve 6 is set to 200 to 1000 μm and it is useful to set to 300 to 700 μm. In the present exemplary embodiment, the gap is set to 500 μm.

In the developing regions "A" and "B", both of the developing sleeves 6 and 7 of the developing device 104 move in a forward direction with respect to a moving direction of the photosensitive drum 101, and moves at a circumferential speed ratio of 2.0 times relative to that of the photosensitive drum. As for the circumferential speed ratio, as long as it is set from 0 to 3.0 times, especially from 0.5 to 2.0 times, whatever times is acceptable. The developing efficiency will be improved as the moving speed ratio becomes larger, but if the moving speed ratio is too large, a problem such as toner scattering, or developer deterioration will arise. Therefore, it is useful to make settings within the above-described range.

A replenishing method for the developer of the developing device will be described. Next, a replenishing method for the developer in the present exemplary embodiment will be described using FIG. 3 and FIG. 4.

On the top of the developing device 104, there is arranged a hopper 12 which accommodates a two-component developer for replenishment with toner and carrier mixed together (normally, toner/developer for replenishment=100% to 80%). The hopper 12 constituting a toner replenishing unit is provided with a screw-shaped replenishing member, i.e., a replenishing screw 13. One end of the replenishing screw 13 extends to a position of a developer replenishing port 11 provided in a fore end portion of the developing device 104.

The toner equivalent to an amount consumed by the image formation passes through the developer replenishing port 11 from the hopper 12, and is replenished into the developer container 2 by a rotational force of the replenishing screw 13, and a gravity of the developer. In this manner, the developer for replenishment is replenished from the hopper 12 into the developing device 104. A replenishing amount of the developer for replenishment is roughly determined according to a number of revolutions of the replenishing screw 13. The number of revolutions is determined by a toner replenishing amount control unit (not illustrated), based on video count value of image data, or a detection result of a toner density detection unit (not illustrated) installed in the developer container 2.

An outline of the developer of the developing device will be described. Here, a two-component developer 1 composed of toner and carrier, which is accommodated in the developer container 2 of the developing device 104 according to the present exemplary embodiment, will be further described in detail.

A toner includes a binder resin and a colorant. In addition, if necessary, the toner includes coloring resin particles containing other additives and coloring particles to which an external additive such as colloidal silica fine powder is externally added. The toner is a polyester-based resin having a negative-chargeability, and a volume average particle diameter may be not less than 4 μm, and not more than 10 μm, and it may be useful to set the volume average particle diameter to not less than 8 μm. Further, in toners in recent years, toners with a low melting point or a toner with a low glass transition point Tg (e.g., Tg≦70° C.) are often used, in order to improve fixiability. Furthermore, wax may be contained in the toner, to improve separability after fixing operation.

Further, the carrier may include, e.g., metals such as surface-oxidized or unoxidized iron, nickel, cobalt, manganese, chromium, and rare earth elements, and alloys thereof, and ferrite oxide, any of which may be suitably used. There are no particular limitations or manufacturing methods for these magnetic particles. The carrier may have weight average particle diameter of 20 to 60 μm, and resistivity of not less than 10^7 Ωcm. And it is useful to have the diameter of 30 to 50 μm, and the resistivity of not less than 10^8 Ω·cm. In the present exemplary embodiment, the carrier having 10^8 Ω·cm is used.

For the toners used in the present exemplary embodiment, volume average particle diameters are measured by an apparatus and a method as shown below. As a measurement apparatus, SD-2000 sheath flow electric resistance particle size distribution measurement apparatus (manufactured by Sysmex Corporation) is used. The measuring method is given as follows. More specifically, a surfactant as a dispersant, preferably 0.1 ml of alkyl benzene sulfonate is added, and 0.5 to 50 mg of measurement sample is added, into 100 to 150 ml of electrolytic aqueous solution of 1% NaCl of aqueous solution prepared by primary sodium chloride. The electrolytic aqueous solution in which samples are suspended is subjected to dispersion processing for about 1 to 3 minutes by an ultrasonic dispersor. Then, the particle size distribution of particles of 2 to 40 μm is measured to determine a volume average distribution using a 100 μm aperture as an aperture, by the above-described SD-2000 sheath flow electric resistance particle size distribution measurement apparatus. The volume average particle diameter is obtained from the thus determined volume average distribution.

A resistivity of the carrier used in the present exemplary embodiment was measured by the use of a sandwich-type cell with a measuring electrode area of 4 cm, a spacing between electrodes of 0.4 cm. The resistivity was measured by a method for obtaining a resistivity of the carrier from an electric current which flows through a circuit, upon applying an applied voltage E (V/cm) between both electrodes to one electrode under pressure of a weight of 1 kg.

From here, a configuration of plural developing sleeves (two developing sleeves in the first exemplary embodiment) which are essential in the exemplary embodiment of the present invention will be described.

A unrotatable fixed magnet roller inside the developing sleeve, and conveyance of the developer will be described. First, in the present exemplary embodiment, the details of the magnet roller fixed in a unrotatable state inside the developing sleeve, and behavior of the developer conveyed on the developing sleeve will be described with reference to FIG. 5.

A roller-shaped first magnetic-field-generating unit (magnet roller) 6*m* is fixedly arranged inside the developing sleeve 6. The first magnet roller 6*m* has a developing magnetic pole S1 facing the first developing region "A". The magnetic brush of the developer is formed by a developing magnetic field which is formed in the first developing region "A" by the developing magnetic pole S1. Then, the magnetic brush comes into contact with the photosensitive drum 101 which rotates in a direction of an arrow "a" in the first developing region "A" to develop the electrostatic latent image in the first developing region "A".

This first magnet roller 6*m* includes N1, N2, N3, S2 poles, in addition to the above-described developing magnetic pole S1, i.e., 5 poles in total. Among these, N2 pole and N3 pole are the same polarities and adjacent to each other inside the developer container 2, and a burrier is formed against the developer 1.

Furthermore, a second developing sleeve 7 serving as a second developer bearing member is disposed rotatably in a direction of an arrow "c", in a region where both the first developing sleeve 6 and the photosensitive drum 101 substantially opposed to each other, on the downstream side of the rotational direction "a" of the photosensitive drum 101, below the above-described first developing sleeve 6. The second developing sleeve 7 is formed of non-magnetic material similarly to the first developing sleeve 6. In the interior thereof, a roller-shaped second magnet roller 7*m* serving as a second magnetic-field-generating unit is installed in a unrotatable state. In this case, the second magnet roller 7*m* includes magnetic poles S3, S4, and N4, i.e., 3 poles in total.

Therefore, to summarize a flow of the developer 1, first, the developer 1 is trapped to N2 (scooping pole) of the first developing sleeve 6, by conveyance and jump-up of the first conveying screw. Next, the developer 1 is conveyed through N2 (scooping pole)→S2 (cutting pole)→N1 (conveyance pole)→S1 (first developing pole)→N3 (transfer pole) along with rotation of the first developing sleeve 6. After that, the developer on the first developing sleeve 6 moves to the second developing sleeve 7, and is conveyed through S3 (receiving pole)→N4 (second developing pole)→S4 (peel-off pole) on the second developing sleeve 7. Finally, the S3 pole and S4 pole have the same polarities and are adjacent to each other inside the developer container 2, and a burrier is formed against the developer 1. Therefore, the developer is released from a magnetic constraint force generated by the magnetic poles, and is conveyed returned to and conveyed by the first conveying screw.

Among them, in an opposing portion of the second developing sleeve 7 and the photosensitive drum 101, in other words, the second developing region "B", a magnetic brush of the developer is formed by a developing magnetic field of N4 pole. The magnetic brush is in contact with the photosensitive drum 101, and further executes a second development, on the electrostatic latent image on the photosensitive drum 101 after passing through the first developing region "A". In this manner, a high developing efficiency can be attained by performing the second development.

As described above, by employing the configuration of providing two developing sleeves, a high developing efficiency becomes possible, even when, for example, a developing time becomes short along with speeding up of the circumferential speed of the photosensitive drum, and good image formation can be achieved without occurrence of degradation of developing concentration or uneven concentration.

Figure 5:
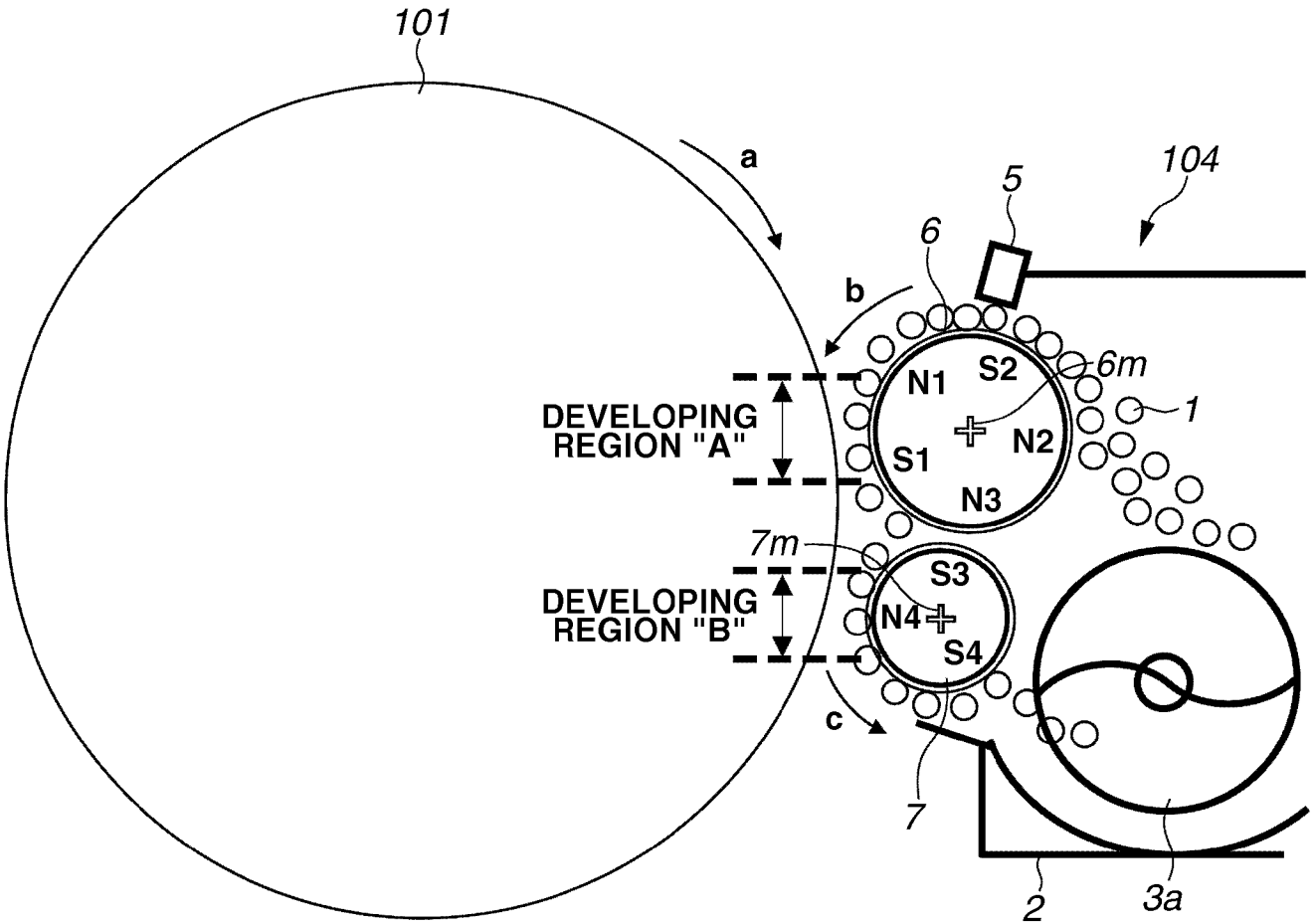
FIG. 5 illustrates an outline around developing sleeves of the developing device according to the first exemplary embodiment of the present invention.

A surface treatment of the developing sleeve will be described. In FIG. 5, the surfaces of the first developing sleeve 6 and the second developing sleeve 7 are subjected to surface treatment over the entire circumferential direction, except for longitudinal end portions. This is because, if the surface of the developing sleeve is smooth like a mirror surface, friction between the developer and the developing sleeve surface becomes extremely small, and as a result, the developer is hardly conveyed. Thus, such a configuration is commonly used as to ensure conveyance amount of the developer, by creating moderate irregularities on the developing sleeve surface, to intentionally create friction between the developer and the developing sleeve surface owing to the irregularities. As a technique for creating the moderate irregularities on the developing sleeve surface, generally the following two methods are available.

[1] Blasting Treatment

A working method for blasting at high pressure particles such as abrasive powder or glass beads having a predetermined particle size distribution on, for example, raw material pipe metal extruded in a sleeve shape under high temperatures, in a cold process. A fine irregularity depth of the surface is about 5 to 15 μm, and the greater the irregularity depth, the higher the developer conveying capacity becomes.

[2] Groove Working Treatment

For example, raw material pipe metal extruded in a sleeve shape under high temperatures is performed drawing in a cold process, and grooves are formed by dies. As a shape of groove, V-shaped type, trapezoid type, U-shape type, or the like (generally, substantially V-shaped shape) is common. Generally, a depth of the groove is about 50 to 150 μm from the surface of the developing sleeve, and a number of grooves is 50 to 120 for, for example, a sleeve with an outer diameter of ϕ20. In this case, the deeper the depth of groove, and the greater the number of grooves, the higher the conveying capacity becomes.

In the first developing sleeve 6 and the second developing sleeve 7 according to the present exemplary embodiment, blasting treatment is effected on the entire circumferential direction.

In this process, as described above, the blasting treatment is not always effected on the whole longitudinal region of the developing sleeve, and generally, portion where the blasting treatment is not effected exists in the end portion of the developing sleeve. This is because a portion serving as a handle for holding and fixing the raw material pipe of the developing sleeve is needed during manufacturing step of the blasting treatment, and as a result, the blasting treatment cannot be effected on the above-described portion serving as the handle.

Hereinafter, the blasting treatment is effected in the longitudinal direction of the developing sleeve, and a region where there is conveying capacity of the developer is referred to as "developer bearing region", and a region where the blasting treatment is not performed at longitudinal end portions of the developing sleeve is referred to as a "non-blasting region". Furthermore, the developer bearing region is generally wider in the longitudinal direction than an image region or an image assured region. It's a matter of course since an image can be formed only in a region where the developer is conveyed.

From here, a configuration of the end portion of the developing device, and a configuration of an end portion cover member, which are the most important points of the present invention, will be described. First, the configuration of conventional end portion will be described. Then, a problem that conventional end portion configuration is inadequate will be made clear, and it will be described that the problem can be solved by applying the end portion configuration according to the exemplary embodiment of the present invention.

Figure 6:
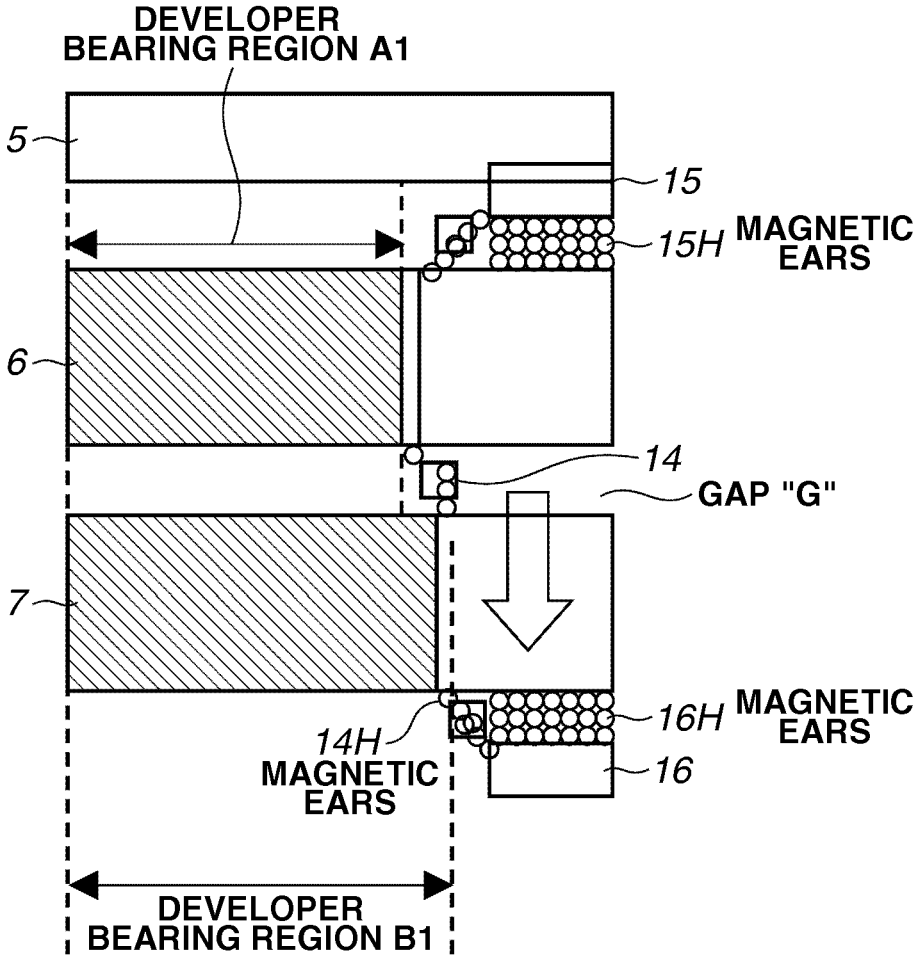
FIG. 6 illustrates an end portion configuration 1 (longitudinal view) of the developing device according to the first exemplary embodiment of the present invention.
Figure 7:
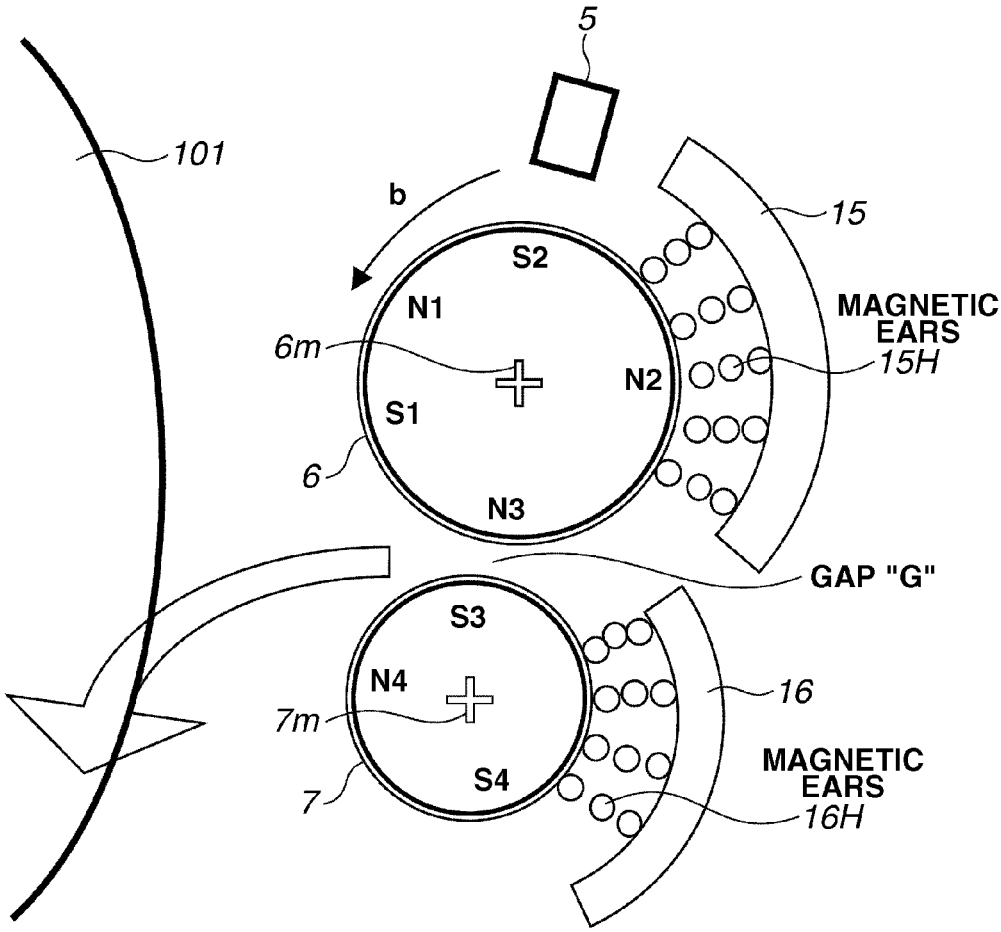
FIG. 7 illustrates an end portion configuration 1 (cross-sectional view) of the developing device according to the first exemplary embodiment of the present invention.

A configuration of the end portion of the developing device will be described. FIG. 6 and FIG. 7 are diagrams for explaining a configuration of the end portion of the developing device according to the present exemplary embodiment. FIG. 6 is a diagram illustrating the end portion of the developing device as viewed from the photosensitive drum side. FIG. 7 is a diagram illustrating a cross-section perpendicular to a rotational axis direction. In FIG. 6, the developer bearing regions of the first developing sleeve 6 and the second developing sleeve 7 are represented with hatched line regions, in other words, which are represented as a developer bearing region A1 for the first developing sleeve 6, and as a developer bearing region B1 for the second developing sleeve 7. In this case, the developer bearing region B1 often extends farther outward in the longitudinal direction than the developer bearing region A1. This is because, when the developer 1 is delivered from the first developing sleeve 6 to the second developing sleeve 7, it involves a sharp change in direction, and thus the developer 1 is liable to diffuse outward.

First, as illustrated in FIG. 6, a magnetic plate 14 is arranged at end portions of the developer bearing regions. The magnetic plate 14 forms the magnetic ears 14H between the first and the second developing sleeves, by magnetic forces of the first magnet roller 6*m* and the second magnet roller 7*m* incorporated, in an unrotatable manner, in the first and the second developing sleeves. More specifically, the developer which receives the forces by rotations of the conveying screws and rotations of the developing sleeves is suppressed from leaking out to the end portions in the longitudinal direction, by formation of the magnetic ears 14H by the magnetic plate 14. In the present exemplary embodiment, the magnetic plate 14 is 0.8 mm thick, uses an SPCC magnetic low carbon steel material as raw material, and is arranged with a gap of about 100 μm from the developing sleeves. A sealing ability by the magnetic ears 14H to be formed is varied according to a thickness of the magnetic plate or a magnetized amount of the raw material, or a distance from the developing sleeve. Accordingly, a configuration of the magnetic plate is not limited to the configuration according to the present exemplary embodiment as a matter of course.

However, depending on a developing sleeve rotational speed, or an endurable number of sheets, an end sealing ability may not be sufficient sometimes only by the magnetic plate.

This is because, as described above, a repulsive magnetic field composed of N2 pole and N3 pole exists in the first magnet roller, and a repulsive magnetic field composed of S3 pole and S4 pole exists in the second magnet roller, respectively, and as a result, a portion where formation of the magnetic ears 14H becomes weak exists at a part in the circumferential direction. In the present exemplary embodiment, to seal the developer which invades into the end portion across such a portion where sealing of the magnetic ears 14H is weak, the first magnet member 15 and the second magnet member 16 are arranged to cover the circumferential direction on the outside of the magnetic plate 14, as illustrated in FIG. 6 and FIG. 7. Therefore, the developer which has invaded into the end portions across the seal of the magnetic plate 14, is held by the magnetic forces of the first magnet member 15 and the second magnet member 16 to form the magnetic ears 15H and 16H. By the thus formed magnetic ears 15H and 16H, the developer which has entered across the magnetic plate 14 can be surely sealed. In the present exemplary embodiment, as a magnet member, a rare earth magnet with a thickness of 2.0 mm and a magnetic flux density of 600 Gaus is arranged with a gap of about 700 μm between the developing sleeve and the magnet member. Similarly to the magnetic plate, the magnet member is not limited to the configuration of the present exemplary embodiment, since a sealing ability of the magnetic ears to be formed is varied according to a thickness or a magnetic flux density or an arrangement of the gap between the developing sleeve and the magnet member.

Figure 8:
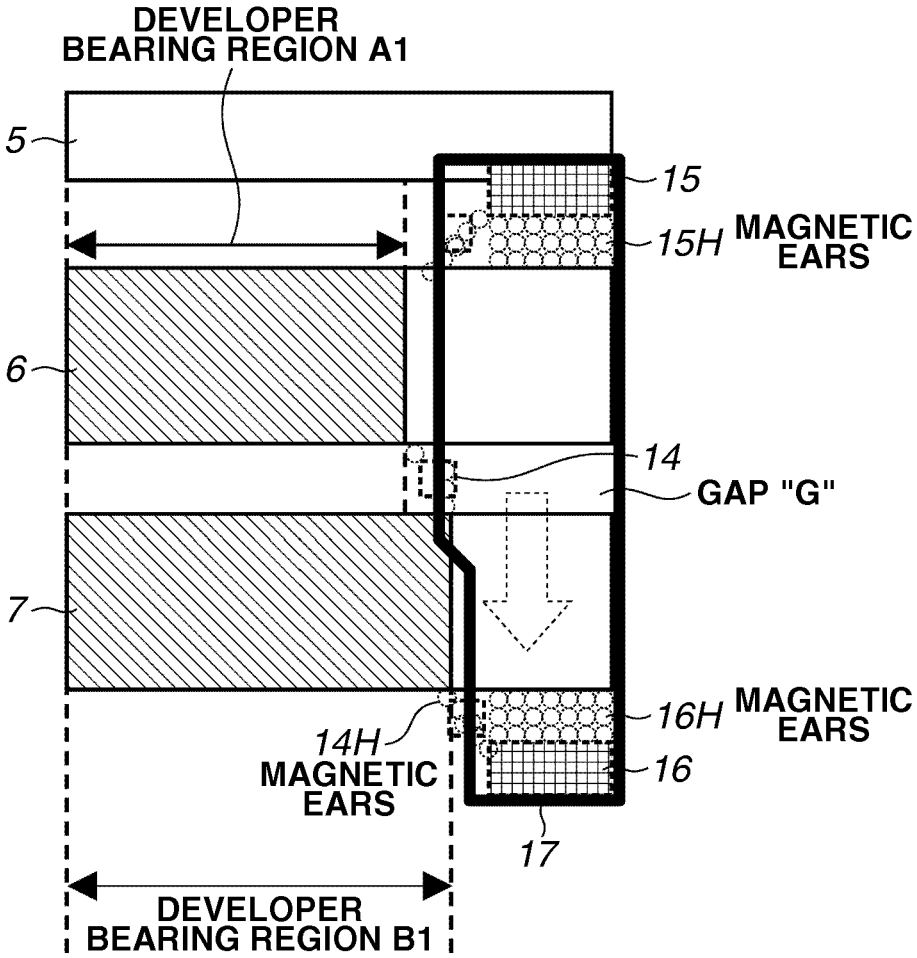
FIG. 8 illustrates an end portion configuration 2 (conventional cover member) (longitudinal view) of the developing device according to the first exemplary embodiment of the present invention.
Figure 9:
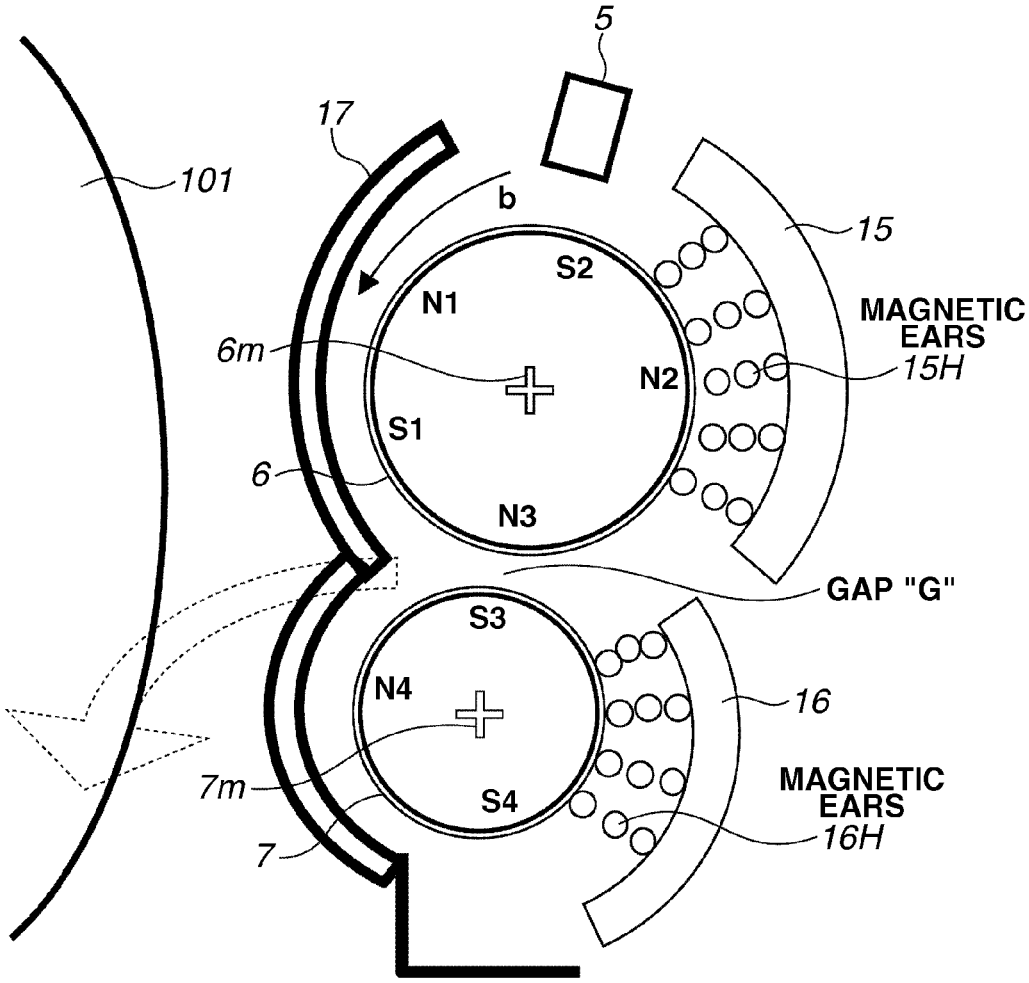
FIG. 9 illustrates an end portion configuration 2 (conventional cover member) (cross-sectional view) of the developing device according to the first exemplary embodiment of the present invention.

A configuration of the conventional end portion cover member will be described. As discussed in the above-described Japanese Patent Application Laid-Open No. 2010-096922, a fine developer leakage cannot be completely prevented only by the seals of the magnetic plate and the magnet member like the ones in FIG. 6 and FIG. 7. More specifically, the developer at the tip of the magnetic bristles 16H held by the second magnet member 16 is taken around by a friction force due to rotation of the second developing sleeve 7. In this case, in a non-blasting region (outside the developer bearing region in sleeve axis line direction) of longitudinal end portion, a part of the toner taken around by the rotation of the second developing sleeve 7 leaks in some cases from a spacing between the developing sleeve 6 and 7 (gap G in FIGS. 6 and 7). Block arrows in FIG. 6 and FIG. 7 represent a route of such a fine developer leakage. Thus, as indicated by bold line frames in FIG. 8 and FIG. 9, if a cover member 17 as discussed in Japanese Patent Application Laid-Open No. 2010-096922 is provided, fine developer leakage into the photosensitive drum or the intermediate transfer belt or other locations in the machine is surely suppressed, and furthermore can be recovered into the developer container.

However, for example, in an environment where a charging amount of the developer is small like a highly humid environment, when further endurance test is conducted, the following phenomenon occurs in some cases. More specifically, at the tips of the magnetic ears 15H and 16H held by the magnet members 15 and 16, following phenomenon occurs in some cases. In the phenomenon toner and carrier are separated from each other by a friction between the developing sleeves 6 and 7 which rotate, and toner aggregates are produced and accumulated in the gaps between the developing sleeves and the magnet members.

Figure 10:
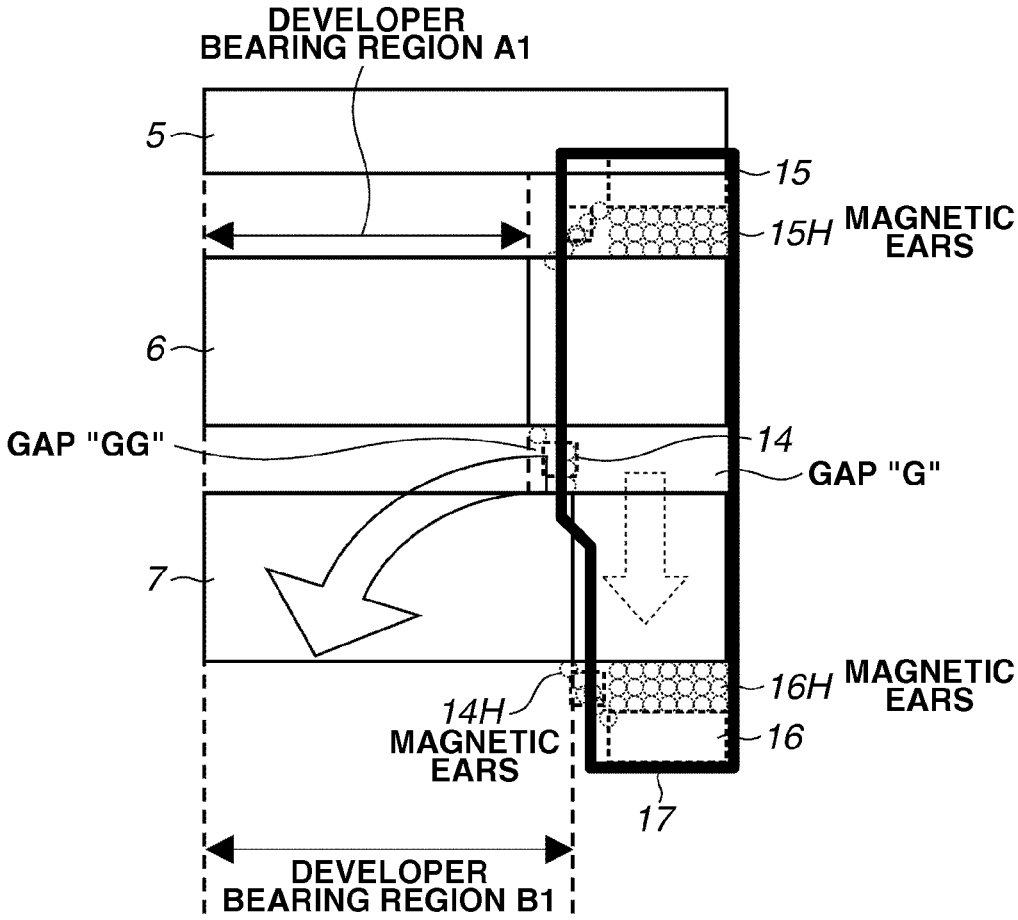
FIG. 10 illustrates an end portion configuration 3 (flying-out direction) (longitudinal view) of the developing device according to the first exemplary embodiment of the present invention.
Figure 11:
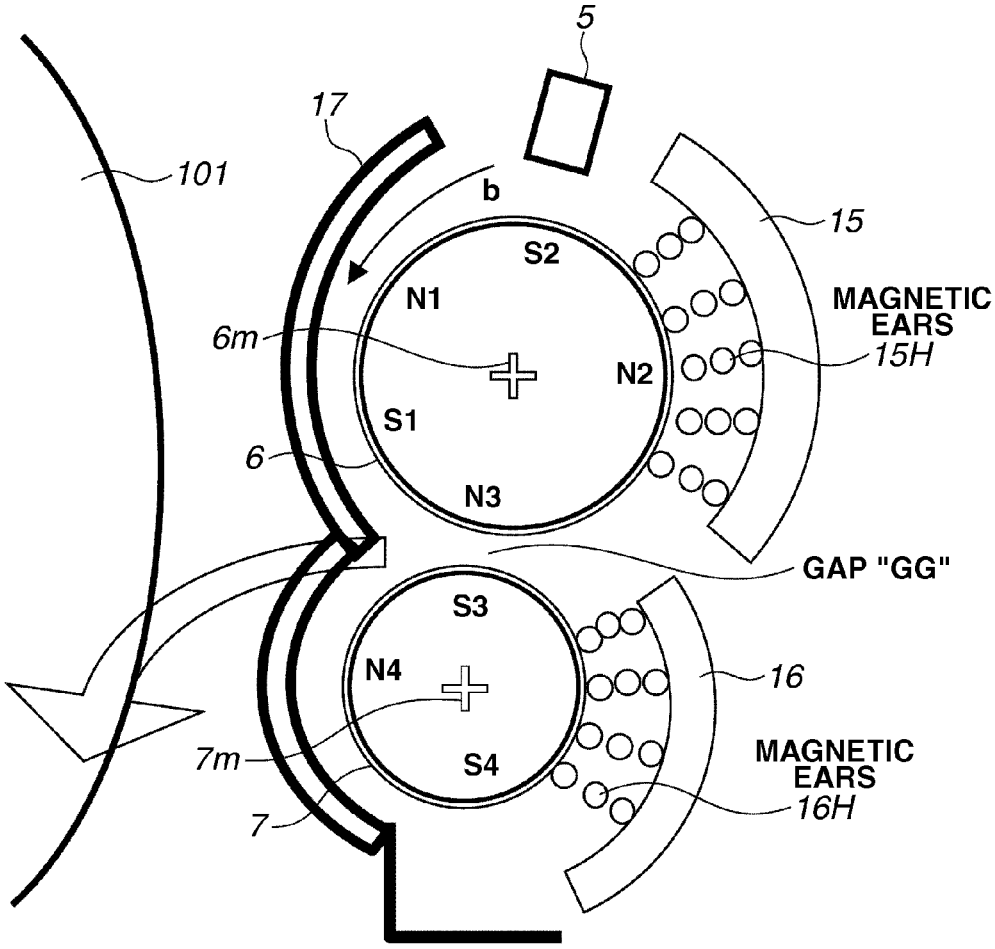
FIG. 11 illustrates an end portion configuration 3 (flying-out direction) (cross-sectional view) of the developing device according to the first exemplary embodiment of the present invention.

Furthermore, when the endurance test is continued, and production/accumulation of the toner aggregates described above progresses, there occurs a phenomenon in which the toner aggregates accumulated in the gap between the second developing sleeve 7 and the magnet member 16 fly out of the gap G, along with the rotation of the developing sleeve 7. The most important point here is that the toner aggregates flying out as described above cannot be shielded by the cover member 17. More specifically, as indicated by block arrows illustrated in FIG. 10 and FIG. 11, the toner aggregates may fly out of the gap GG which exists on the center side in the longitudinal direction. This is because the toner aggregates cannot be shielded by the cover member 17, since the toner aggregates are flying out toward the center in the longitudinal direction from an additional gap which is present between the gap G and the cover member 17. Here, gap GG refers to a region not covered by the cover member 17 as viewed from the drum direction, and a region where the developer to be transferred between the developing sleeves 6 and 7 does not exist, within the space represented by the gap G. The reason why the toner aggregates fly out toward the center in the longitudinal direction in this manner, is because the toner aggregates are sufficiently accumulated in the gap between the developing sleeve 7 and the magnet member 16. Then, it is thought that the toner aggregates instantaneously receives a force directed toward the center in the longitudinal direction, by being released from a pressure of accumulation. Further, it is revealed that the toner flying out of between the developing sleeves, is mainly the one flying out of a closest proximity portion between the developing sleeve 6 and the developing sleeve 7. This is because, in the closest proximity portion between the developing sleeve 6 and the developing sleeve 7, moving directions of the developing sleeves become opposite to each other, and as a result, of the toner taken around by the developing sleeve 7, a part of the toner is returned into the developer container by an air draft produced by the rotation of the developing sleeve 6. However, it is thought that the toner after passing through the closest proximity portion between the developing sleeve 6 and the developing sleeve 7, mostly flies out toward the drum direction from the neighborhood of the closest proximity position, since an influence of the air draft of the developing sleeve 6 becomes sharply small.

Here, in the configuration of the end portion cover member according to the present exemplary embodiment in accordance with the present invention, as will be described below, such the toner aggregates flying out toward the center in the longitudinal direction can be shielded.

Figure 12:
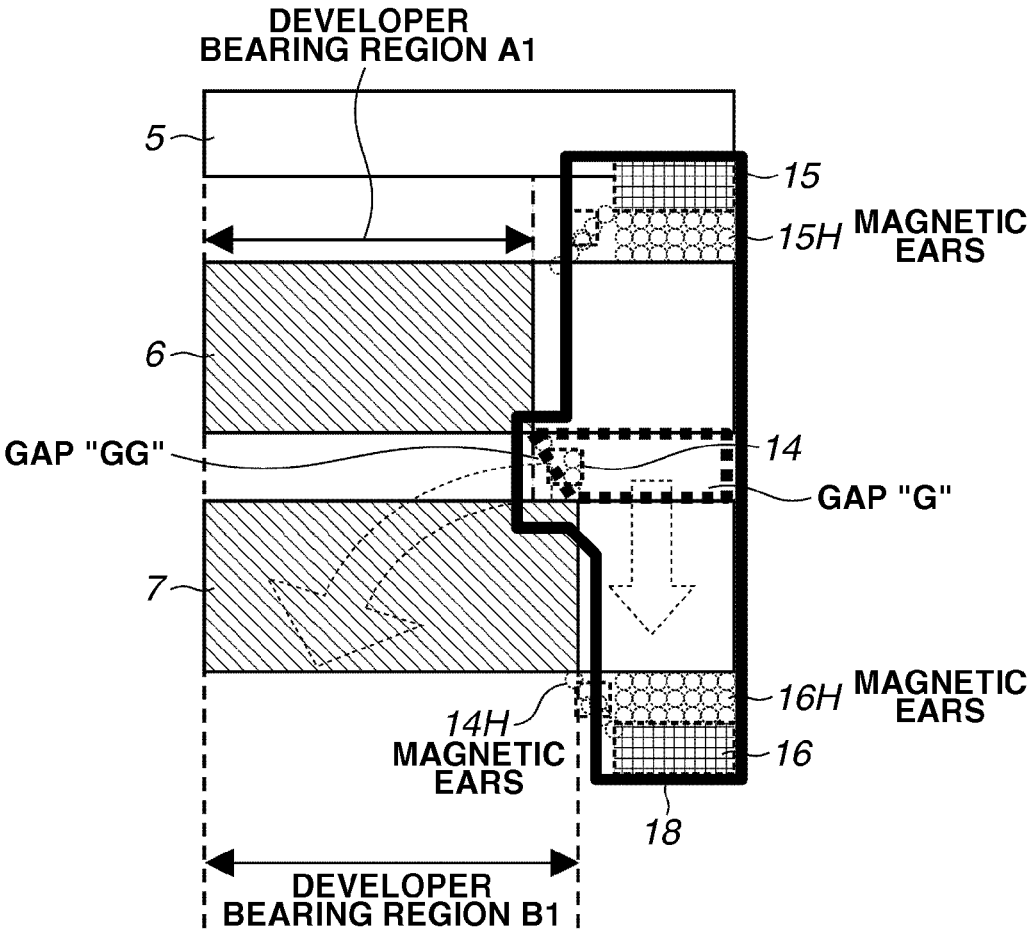
FIG. 12 illustrates an end portion configuration 4 (longitudinal view) of the developing device according to the first exemplary embodiment of the present invention.

A configuration of the end portion cover member according to the present exemplary embodiment in accordance with the present invention will be described. Here, a cover member 18 indicated by a bold line frame in FIG. 12, is the end portion cover member according to the present exemplary embodiment in accordance with the present invention. The feature is, in the cover member 18, to have a region which shields over a predetermined region located on inner side than either of the developer bearing regions of the developing sleeve 6 and 7, with respect to axis line directions of the developing sleeves 6 and 7. By doing so, in the present exemplary embodiment, the toner flying directed inward from outside the developer bearing regions and adhering to the drum, with respect to the longitudinal directions of the developing sleeves 6 and 7, can be suppressed.

In the present exemplary embodiment, in the spacing between the developing sleeves 6 and 7, it is configured such that the gap G and the gap GG, which are located at longitudinally outward end portions, are completely covered by the cover member as viewed from the photosensitive drum direction. If the cover member 18 with such configuration is provided, the toner aggregates flying out of the gap G and the gap GG described above can be effectively shielded.

Further, in the present exemplary embodiment, a shape of the cover member is in the following relationship. First, the cover member is in the following relationship with respect to the longitudinal direction of the developing sleeve. [1] A boundary of the center side of the longitudinal direction, is to enter further center side of the longitudinal direction than a boundary formed by the magnetic ears of the developer conveyed from the developer bearing region A1 to the developer bearing region B1, and a space where there is no developer in the non-blasting regions of longitudinal end portions of the developing sleeves 6 and 7. More specifically, the cover member is to shield a region inner than the end portion of either of the developer bearing regions of the developing sleeves 6 and 7, with respect to the axis line direction of the developing sleeves 6 and 7. [2] A boundary on longitudinal end portion side is to extend up to outer end portions than end portions of the non-blasting regions of the longitudinal end portions of the developing sleeves 6 and 7.

Figure 13:
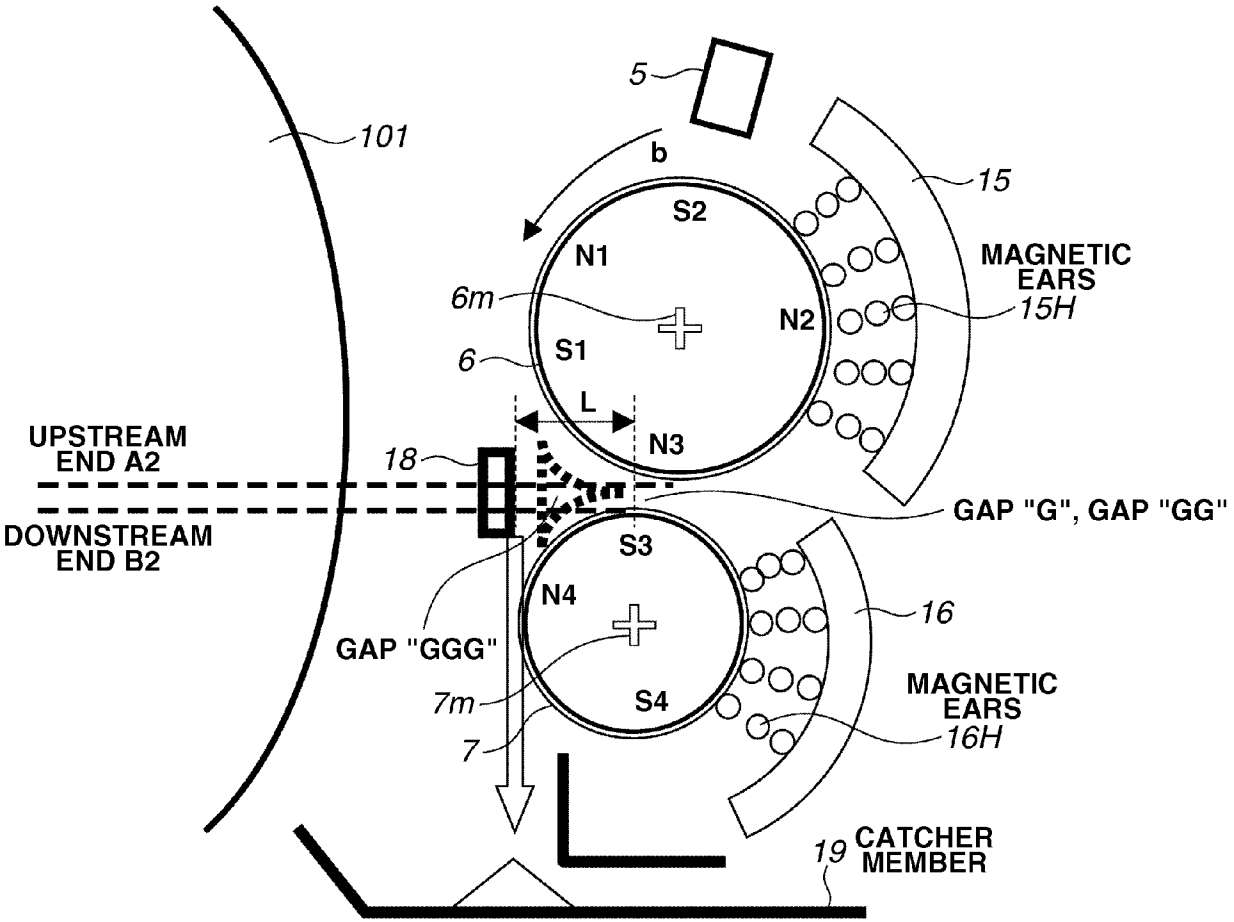
FIG. 13 illustrates an end portion configuration 4 (cross-sectional view) of the developing device according to the first exemplary embodiment of the present invention.

Further, the cover member is in the following relationship with a direction orthogonal to the developing sleeve longitudinal direction (direction between-axes of the developing sleeves 6 and 7). More specifically, as illustrated in FIG. 13, the cover member is to block out a route from at least the gap between the developing sleeves 6 and 7 toward the drum (a region sandwiched by tangential lines A2, B2 of the developing sleeves 6 and 7, in the closest proximity portion of the developing sleeves 6 and 7). Specifically, in the present exemplary embodiment, [3] a boundary on the upstream side of the circumferential direction (the highest point position in gravity direction) is to be located on an upper side than the perpendicularly downward lowest point in the circumferential direction of the developing sleeve 6. [4] A boundary on the circumferentially downstream side (the lowest point position in a gravity direction) is to be located on a lower side than the perpendicularly upward uppermost point, in the circumferential direction of the developing sleeve 7. A state where the cover member has satisfied the above states is called "a state where the gap G and gap GG are completely covered by the cover member, as viewed from the photosensitive drum direction". To show in the figure, the state refers to covering a region surrounded by bold dotted lines in FIG. 12 (i.e., gap G+gap GG region). The toner aggregates flying out of the above-described gap between the end portions, as illustrated in FIG. 13, do not reach the photosensitive drum, by being shielded by the cover member 18, and deposit on a toner drop catcher member 19 arranged at the bottom of the developing device. The toner aggregates are also prevented from dropping onto the intermediate transfer belt. In this manner, with the use of the cover member 18 according to the present invention, occurrence of toner drop images can be suppressed despite its simple configuration.

As the cover member 18 in the present exemplary embodiment, an urethane sheet with a thickness of 100 μm is used. As a material of the cover member, insulation properties with the above-described developing bias are required. In the present exemplary embodiment, however, the urethane sheet is selected from viewpoint of simplicity of working, but of course it is not limited to this. Further, the cover member 18 according to the present exemplary embodiment is fixed such that, an upper end portion is fixed to the regulating member 5 with double-faced tape, a lower end portion is fixed to the developer container 2 with the double-faced tape, and longitudinal outward end portion is fixed to the developer container 2 with the double-faced tape. By fixed the upper end and lower end portions, a position of the cover member is stable through endurance, so that the shielding ability can be maintained. In the present exemplary embodiment, the upper end and lower end portions of the cover member are fixed to the developer container 2. Consequently, in a region adjacent to the developing regions of the developing sleeves 6 and 7, with respect to sleeve axis line direction, a width in the longitudinal direction is designed to be narrow, so that the cover member may not block the developing regions. On the other hand, a region corresponding to a gap between the developing sleeves 6 and 7 is designed to be wide in a width in the longitudinal direction. Specifically, as illustrated in FIG. 12, a region corresponding to the gap between the developing sleeves 6 and 7 has a projection portion which projects inward, with respect to the axis line direction of the developing sleeves 6 and 7. By forming the cover member in such shape, a position of the cover member is stable through endurance, and a toner flying toward an image formation region of the drum from a sleeve gap in the sleeve end portions can be suppressed, while maintaining the shielding ability.

Further, as for longitudinally outward end portions, as in the explanation of the above-described cover shape [2], if a shape of the cover member extends to outer side than the non-blasting region of the developing sleeves 6 and 7, it is not necessarily required to fix the cover member. However, if the longitudinally outward end portions are fixed, a toner scattering from outward end portions of the cover member 18 can be shielded, which results in more desirable configuration. However, it should be noted that a toner scattering from the outward end portions of the cover member 18, is not a cause for producing toner drop images which the present invention puts an issue, but is a cause for producing in-machine toner stain within the image forming apparatus. In the present exemplary embodiment, a fixing method for the cover member 18 is not limited to this, but the fixing method may be changed as appropriate, depending on, e.g., a shape of the developer container 2.

Further, the position of the cover member 18 is provided on the route between the developing sleeves 6 and 7 and the photosensitive drum 101, but at least in the developer bearing regions, the cover member 18 is arranged so that the cover member 18 may not come into contact with either of the developing sleeves 6 and 7 and the photosensitive drum. This is because, for example, when the cover member 18 is in contact with the developing sleeves 6 and 7, the cover member 18 enters the developer bearing regions, and accordingly the developer may jump over and invade between the cover member and the photosensitive drum, and a carrier-adhering image may be produced. This is also because, for example, when the cover member is in contact with photosensitive drum, the cover member may disturb an end portion of a toner image visualized by the developing sleeve 6.

Further, as for a gap between the upstream sleeve 6 and the regulating member 5 in the non-blasting regions of longitudinal end portions, the gap is about 500 μm. Since this is far smaller than the gap of about 1000 μm between the developing sleeves 6 and 7, flying out of the toner aggregates does not occur even if the cover member 18 is not provided in the developing device according to the present exemplary embodiment. However, since the cover member 18 according to the present exemplary embodiment, as described above, is fixed to the regulating member 5, it is configured so that even when the toner aggregates fly from the gap in a longitudinal end portion non-blasting region between the upstream sleeve 6 and the regulating member 5, the toner aggregates can be shielded.

As described above, the cover member is provided in the spacing between the developing sleeves 6 and 7, in accordance with the present invention. The gap G and the gap GG located at the longitudinally outward end portion are completely covered as viewed from the photosensitive drum direction, by the cover member. By doing so, it is possible to provide the developing device wherein flying out of the toner aggregates is effectively shielded, and occurrence of toner drop is suppressed.

A second exemplary embodiment will be described. Even if the cover member which can completely shield the gap G and the gap GG as viewed from the photosensitive drum direction is provided according to the above-described first exemplary embodiment, some amount of toner drop occurs in some cases, during the endurance test continues for a long period of time, depending on endurance conditions (e.g., when atmospheric temperature of the developing device is high). Thus, the present inventors observed phenomenon to occur of the toner drops in more detail.

As a result, depending on the endurance conditions, an amount of the toner aggregates accumulated on the gap between the second developing sleeve 7 and the magnet member 16 increases, and a pressure which the accumulated toner aggregates receive from rotation of the sleeve increases. Then, at the moment that the accumulated toner aggregates are released from the above-described pressure, it was found that they may receive a bigger force directed toward the center of longitudinal direction. Then, when the thus accumulated toner aggregates receive a big force directed toward the center of the longitudinal direction, the toner aggregates fly out of a gap GGG (gap in triangular shape indicated by dotted lines in FIG. 13) formed by the cover member 18 according to the first exemplary embodiment and the developing sleeves 6 and 7 toward the center of the longitudinal direction. Thereby, it was found that toner drop image is produced. Thus, in the second exemplary embodiment of the present invention, by providing a cover member 20 in a configuration as will be described below, which is an improvement of the first exemplary embodiment, flying of the toner aggregates can be effectively prevented, and occurrence of toner drop image can be suppressed.

Figure 14:
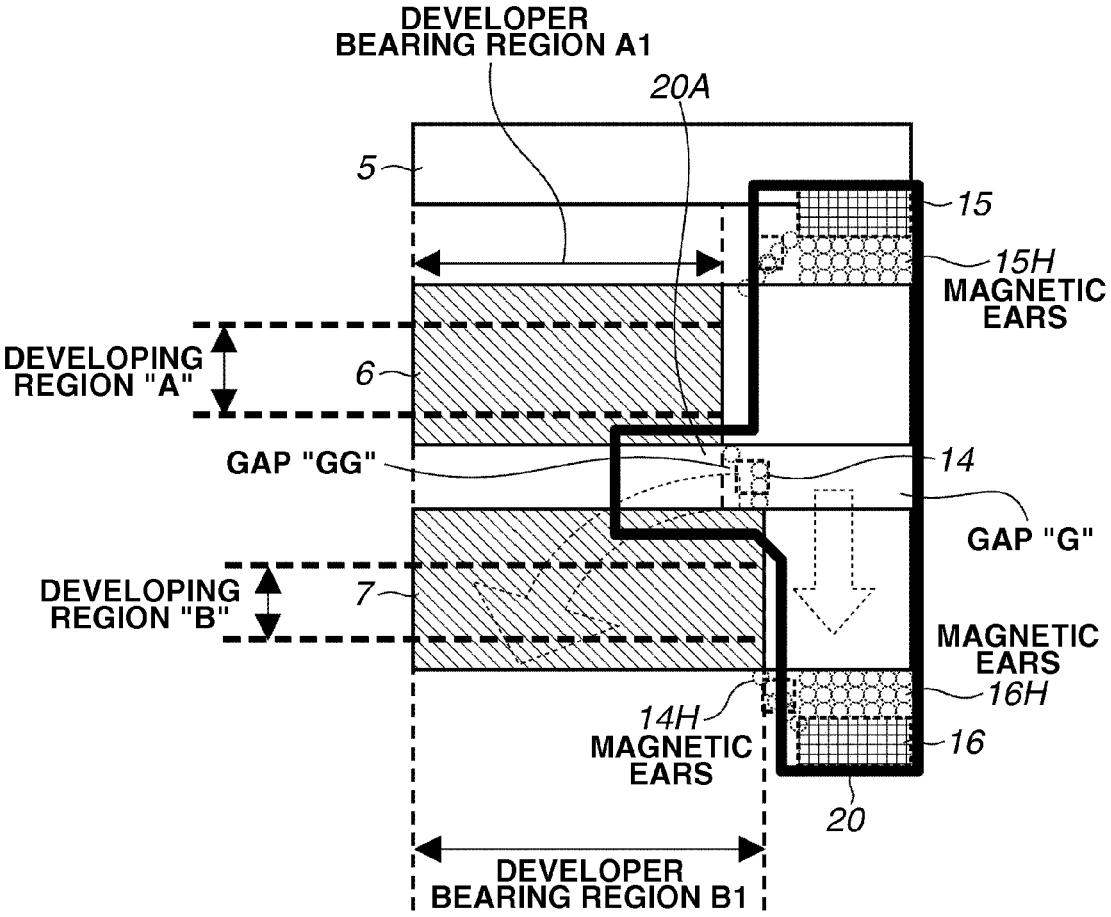
FIG. 14 illustrates an end portion configuration 5 (longitudinal view) of the developing device according to a second exemplary embodiment of the present invention.

Here, the cover member 20 according to the present exemplary embodiment indicated by bold line frame in FIG. 14 will be described in detail. However, a material of the cover member 20 according to the present exemplary embodiment is urethane sheet which is the same as that of the cover member 18 according to the above-described first exemplary embodiment, and it should be noted that the point of the present exemplary embodiment is a shape of the cover member.

First, the cover member 20 is provided in the position of the route between the developing sleeves 6 and 7 and the photosensitive drum 101, but is arranged so that the cover member 20 may contact with none of the developing sleeves 6 and 7 and the photosensitive drum. This is because, for example, if the cover member 20 is in contact with the developing sleeves 6 and 7, the cover member 20 has entered into the developer bearing regions, so that the developer may jump over and invade between the cover member and the photosensitive drum, and carrier-adhering image may occur. This is also because, for example, if the cover member is in contact with the photosensitive drum, the cover member may disturb end portion of toner image visualized by the developing sleeve 6.

Next, there will be described a length in the circumferential direction along the developing sleeve, of a portion 20A, within the cover member 20, which enters the developer bearing regions A1 and B1.

The longer the length in the circumferential direction of the portion of 20A within the cover member 20, the more effectively the toner aggregates flying out of the gap G and the gap GG can be shielded. However, for example, if too long in the circumferential direction of the upstream developing sleeve 6, adverse effects such as interfering with development of the toner performed by the upstream developing sleeve 6, and the concentration becoming weak may occur.

Therefore, a circumferentially upper end of the portion of 20A within the cover member 20 needs to be located on downstream side than downstream end of developing region "A" by the upstream developing sleeve 6. In the present exemplary embodiment, the circumferentially upper end of the portion of 20A within the cover member 20 exists at a position 1.0 mm downstream than the downstream end of the developing region "A". Similarly, a circumferentially downstream of the portion of 20A within the cover member 20 needs to be located on the upstream side than the upstream end of the developing region "B" by the downstream developing sleeve 7. In the present exemplary embodiment, a circumferentially downstream end of the portion of 20A within the cover member 20 exists at a position 1.0 mm upstream than upstream end of the developing region "B".

Further, it is desirable for a circumferential length of the portion of 20A within the cover member 20 that an upstream end of the portion of 20A within the cover member 20 (the highest point in gravity direction) exists upstream than an upstream end of the gap G being the spacing between the developing sleeves 6 and 7. In other words, it is desirable that the upstream end of the portion 20A within the cover member 20 exists upper than the upstream end A2 in FIG. 13. If the upstream end of the portion of 20A within the cover member 2 exists downstream than the upstream end A2, shielding effect becomes sharply weak. After all similarly, the circumferential length of the portion of 20A within the cover member 20 is desirably determined such that the downstream end (the lowermost point in gravity direction) of the portion of 20A within the cover member 20 exists downstream of the downstream end of the gap G being the spacing of the developing sleeve 6 and 7. In other words, it is desirable that a downstream end of the 20A portion within the cover member 20 exists lower than a downstream end B2 in FIG. 13. If the downstream end of the portion of 20A within cover member 20 exists upstream of the downstream end B2, the shielding effect becomes sharply weak.

Here, in the present exemplary embodiment, the portion of 20A of the cover member 20 can shield the toner aggregates from flying out toward the photosensitive drum direction, but it is configured so that the shielded toner aggregates drop perpendicularly downward. Therefore, if the center positions of the upstream and downstream developing sleeves are both arranged at a position under a horizontal direction with respect to the center position of the photosensitive drum, shielding effect is high.

Finally, a length of entering the developer bearing regions about longitudinal direction of the cover member 20 will be described. If only conditions for the described above position and the circumferential length of the portion of 20A within the cover member 20 are satisfied, there is no problem with a longer length in the longitudinal direction. For example, even if the cover member 20 of longitudinally front side and the cover member 20 of longitudinally back side may continue to be longitudinally extended each other, and finally both may be connected to each other, there will be no particular problem. However, in a case where the cover member 20 according to the present invention is connected between front side and back side in the longitudinal direction, it is necessary to consider hardness of raw materials so that the cover member 20 may not come into contact with the developing sleeves or the photosensitive drum at a longitudinal central part, due to deflection or the like.

On the other hand, if the longitudinal length is too short, the effectiveness of suppressing the flying out of the toner aggregates is weaker and becomes equivalent to the configuration of the first exemplary embodiment. Thus, entering length in the longitudinal direction will be discussed below.

A maximum initial speed of the toner aggregates flying out of the above-described gap GGG is equivalent to a rotation speed of the second developing sleeve 7. In the present exemplary embodiment, since the rotation speed of the second developing sleeve 7 is 500 rpm, and a diameter is 20 mm, then the maximum initial speed of the toner aggregates is about 523 mm/s. Further, since a force due to the rotation of the second developing sleeve 7 is predominant, a vector direction of the initial speed is such that a force in the longitudinal direction is definitely smaller than that in the circumferential direction. In other words, when considering an axis with a circumferential downstream direction of 0°, and a longitudinal center direction of 90°, a vector direction of the initial speed becomes an orientation of 0° to 45°. Therefore, a maximum value of longitudinal component of the initial speed, in the present exemplary embodiment, is about 370 mm/s even at maximum.

Here, when considering a time taken until the toner aggregates flying out at an initial speed with maximum longitudinal component collide with the cover member 20, it is only necessary to consider a case of a uniform motion at the initial speed of 370 mm/s over a distance L indicated in FIG. 13. However, a distance L represents a distance from an upper end of the second developing sleeve's diameter to the cover member 20. In the present exemplary embodiment, since the distance L=10 mm, required time becomes about 0.027 sec. In a time required by them to travel the distance L, when a distance travelled further in the longitudinal direction is calculated, it is found that the toner aggregates can fly by the distance L even in the longitudinal direction, since the longitudinal initial speed component is 370 mm/s. Therefore, in the present exemplary embodiment, from a rotation speed of the developing sleeve and arrangement of the cover member 18, if the cover member 20 enters the developer bearing region by just 10 mm in the longitudinal direction, the toner aggregates can be completely prevented from flying to the image bearing member. In practice, since a probability of producing the toner aggregates having the above-described speed component of 45° is very small, according to the experiment conducted by the inventors, sufficient effectiveness can be obtained even from an entering length of about 3 mm.

Hereinbefore, with the configuration according to the present exemplary embodiment in accordance with the present invention, the toner aggregates flying out of the above-described gap GGG can be effectively shielded.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-273912 filed Dec. 8, 2010, which is hereby incorporated by reference herein in its entirety.

What is claimed is:

1. A developing device comprising:

a first developer bearing member configured to bear a developer including a toner and a carrier, and to convey the developer to a first developing region facing an image bearing member, so as to develop an electrostatic latent image formed onto the image bearing member;

a second developer bearing member configured to bear a developer transferred from the first developer bearing member, and to develop an electrostatic latent image formed on the image bearing member, by conveying a developer to a second developing region facing the image bearing member; and a cover unit configured to not overlap respective developing regions at end portions in axis line direction of the first and the second developer bearing members, and to shield a route toward the image bearing member from a mutual gap position between the first developer bearing member and the second developer bearing member to the image bearing member, wherein the cover unit has a projection portion that projects with respect to an axis line direction of the first developer bearing member, so as to shield more inward regions than end portions of respective developing regions between the respective developing regions.

2. The developing device according to claim 1, wherein a length of the projection portion is equal to or greater than a length to the cover unit from a position which is a closest proximity position between the first developer bearing member and the second developer bearing member.

3. The developing device according to claim 1, wherein the projection portion is provided not to overlap respective developing regions.

4. The developing device according to claim 1, wherein one end of the cover unit is fixed to a regulating member that regulates a layer thickness of the first developer bearing member, and the other end of the cover unit is attached to the developing device on downstream side in a rotational direction of the second developer bearing member.

* * * * *